United States Patent [19]

Laskaris

[11] Patent Number: 4,535,596

[45] Date of Patent: Aug. 20, 1985

[54] PLUG FOR HORIZONTAL CRYOSTAT PENETRATION

[75] Inventor: Evangelos T. Laskaris, Schenectady, N.Y.

[73] Assignee: General Electric Company, Schenectady, N.Y.

[21] Appl. No.: 595,200

[22] Filed: Mar. 30, 1984

[51] Int. Cl.[3] ..... F17C 1/00

[52] U.S. Cl. ..... 62/45; 62/514 R

[58] Field of Search ..... 62/45, 514 R

[56] References Cited

U.S. PATENT DOCUMENTS

| | | | |
|---|---|---|---|
| 3,066,222 | 11/1962 | Poorman et al. | 62/514 R |
| 3,309,884 | 3/1967 | Pauliukonis | 62/45 |
| 3,377,813 | 4/1968 | Mordhorst | 62/45 |
| 3,399,691 | 9/1968 | Schoch et al. | 62/45 |
| 3,483,709 | 12/1969 | Biacher et al. | 62/514 R |
| 3,714,942 | 2/1973 | Fischel et al. | 62/45 |
| 4,223,540 | 9/1980 | Longsworth | 62/514 R |

*Primary Examiner*—Ronald C. Capossela

*Attorney, Agent, or Firm*—Lawrence D. Cutter; James C. Davis, Jr.; Marvin Snyder

[57] ABSTRACT

A plug for a horizontal cryostat penetration comprises a plurality of nested housings with thermal insulation disposed between the housings. Each housing has a tubular extension which is heat stationable to portions of the cryostat penetration, the more inner the housing, the colder being the portion to which it is stationed. The innermost and outermost housings each possess pressure relief means for relieving internal pressure buildup which occurs as a result of magnet quench or vacuum loss. In operation the plug is disposed within the cryostat penetration and in particular, typically within a tubular conduit associated therewith. The tubular extension of the outermost housing also has preferably disposed around its exterior, one or more string-shaped helically disposed lengths of sealing material. Accordingly, when the plug is placed within the penetration, a helical coolant vapor path is formed for plug cooling and exterior ventilation.

16 Claims, 2 Drawing Figures

PLUG FOR HORIZONTAL CRYOSTAT PENETRATION

BACKGROUND OF THE INVENTION

The present invention is generally directed to horizontal penetrations extending between the inner and outer walls of a cryostat, particularly one employing liquid helium as a coolant material. More particularly, the present invention is directed to a penetration plug which employs a plurality of thermally insulated nested housings which are heat stationed to several cryostat penetration structures so as to prevent large temperature gradients from occurring between the interior and exterior of the cryostat. Even more particularly, the present invention is directed to a cryostat plug for horizontal penetrations employing electrically conductive leads which extend from the penetration in normal operation (that is, leads which are non-retractable).

In the generation of medical diagnostic images in nuclear magnetic resonance (NMR) imaging, it is necessary to provide a temporally stable and spatially homogenous magnetic field. The use of superconductive electrical materials maintained at a temperature below their critical transition temperatures, provides an advantageous means to produce such a field. Accordingly, for such NMR imaging devices, a cryostat is employed. A cryostat contains an innermost chamber in which liquid helium, for example, is employed to cool the superconductive materials. The cryostat itself, typically comprises a toroidal structure with other nested toroidal structures inside the exterior vessel to provide the desired vacuum conditions and thermal shielding. Since it is necessary to provide electrical energy to the main magnet coil, to various correction coils and to various gradient coils employed in NMR imaging, it is necessary that there be at least one penetration through the cryostat vessel walls.

Typical prior art penetrations have been vertical. However, from a manufacturing viewpoint, the construction of vertical penetrations has produced undesirable problems of alignment and assembly. However, horizontal cryostat penetrations have not been employed for reasons of thermal efficiency. In particular, it is seen that for a coolant such as liquid helium, that there is a large dependency of density upon temperature. Accordingly, liquid helium vapor found within a vertical penetration, is naturally disposed in a layered configuration as a result of the density variation from the bottom to the top of the penetration. This layering provides a natural form of thermal insulation along the length of a vertical penetration. In particular, at any position along the axis of such penetration, the temperature profile is substantially constant. However, this would not be the case for a horizontal cyrostat penetration since any layering that would result would not be in the direction of the long axis of the cryostat penetration. Accordingly, the temperature gradient along the penetration would tend to set up free convection currents in the vapor within the penetration. This would result in a much more rapid loss of coolant than is desired. Since the cost of helium is relatively high, it is seen that this loss of coolant is undesirable.

Moreover, as a result of an as not yet fully understood phenomena, it is possible for superconductive windings within the cryostat to undergo a sudden transition from the superconducting state to the normal resistive state. In this circumstance, the electrical energy contained within the coil is rapidly dissipated as resistive ($I^2R$) heating of the windings. This can result in a rapid increase in internal helium vapor pressure and accordingly, any cryostat penetration must be provided with pressure relief means. Furthermore, vacuum conditions are maintained between the innermost and outermost cryostat vessels. If for some reason a loss of vacuum occurs in this volume, it is also possible to develop an increase in the coolant vapor pressure. For this reason also, pressure relief means are desirable for cryostat penetrations.

As indicated above, electrical connections must be provided through the cryostat wall to accommodate the electrical apparatus contained therein at the desired lower temperature. In some cryostat penetration designs, the electrical connections to the internal coils are made through an electrical lead assembly which is disposed entirely within an inner cryostat vessel. In such a configuration, there is a tendency for frost buildup upon the contacts and these contacts often must be heated to a temperature of about 300° K. prior to making the electrical connection. It is, of course, undesirable that interior cryostat objects must be heated. It should also be understood that because of the superconducting nature of the coils disposed within the innermost cryostat vessel, that a "persistant current" mode of operation is intended. In such a mode, once the desired currents are established, the electrical power supply to the electrical elements within the innermost vessel may be disconnected. This is an advantageous mode of operation since it is highly energy efficient. However, it is seen that this method of operation exhibits the disadvantage that the electrical leads may have to be heated to provide the desired electrical contact, particularly during original magnet excitation. However, many of these problems are avoided by providing a non-retractable electrical lead assembly disposed within the penetration. However, the utilization of a non-retractable assembly introduces insulation, convection current and pressure relief problems which are not present in a retractable lead cryostat design.

Accordingly, it is seen that because of the large density changes between cold and warm helium, free convection the secondary flows are easily set up in a horizontal cryostat penetration. These flows considerably degrade the thermal efficiency of the horizontal penetration. It is also desirable to avoid the formation of frost buildup in the vapor cooled plug which could prevent the desired pressure relief. It is therefore seen that horizontal cryostat penetrations for NMR magnet cryostat require thermally efficient plugs that suppress free convection coolant vapor flow in the penetration. These plugs should also provide sufficient exhaust means to relieve internal pressure buildup in case of magnet quench or vacuum loss. Additionally, these plugs should also accommodate the utilization of non-retractable electrical leads.

SUMMARY OF THE INVENTION

In accordance with a preferred embodiment of the present invention, a plug for a horizontal cryostat penetration comprises a plurality of nested housings with thermal insulation disposed between them, each such housing having a tubular extension which is heat stationable to a portion of the cryostat penetration. The more inner tube housing, the colder being the temperature at which it is stationed. The plug also includes pressure relief means, preferably in the form of burst or rupture disks located adjacent to one another at the "warm" end of the plug. Furthermore, the plug is constructed so as to be able to maintain vacuum conditions therein.

Accordingly, it is an object of the present invention to provide a vacuum jacketed horizontal plug for a cryostat.

It is another object of the present invention to provide a horizontal plug for a horizontal cryostat penetration in a liquid helium cooled cryostat.

It is yet another object of the present invention to provide a horizontal cryostat plug for a cryostat usable in NMR imaging for medical diagnostic purposes.

It is also an object of the present invention to provide a vacuum jacketed horizontal plug for use in cryostats having non-retractable electrical leads which are vapor cooled and extend outside the outermost cryostat vessel.

It is yet another object of the present invention to provide a horizontal cryostat plug including pressure relief means.

Lastly, but not limited hereto, it is an object of the present invention to provide a thermally insulated plug for a horizontal cryostat penetration.

DESCRIPTION OF THE FIGURES

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION OF THE INVENTION

Figure 1:
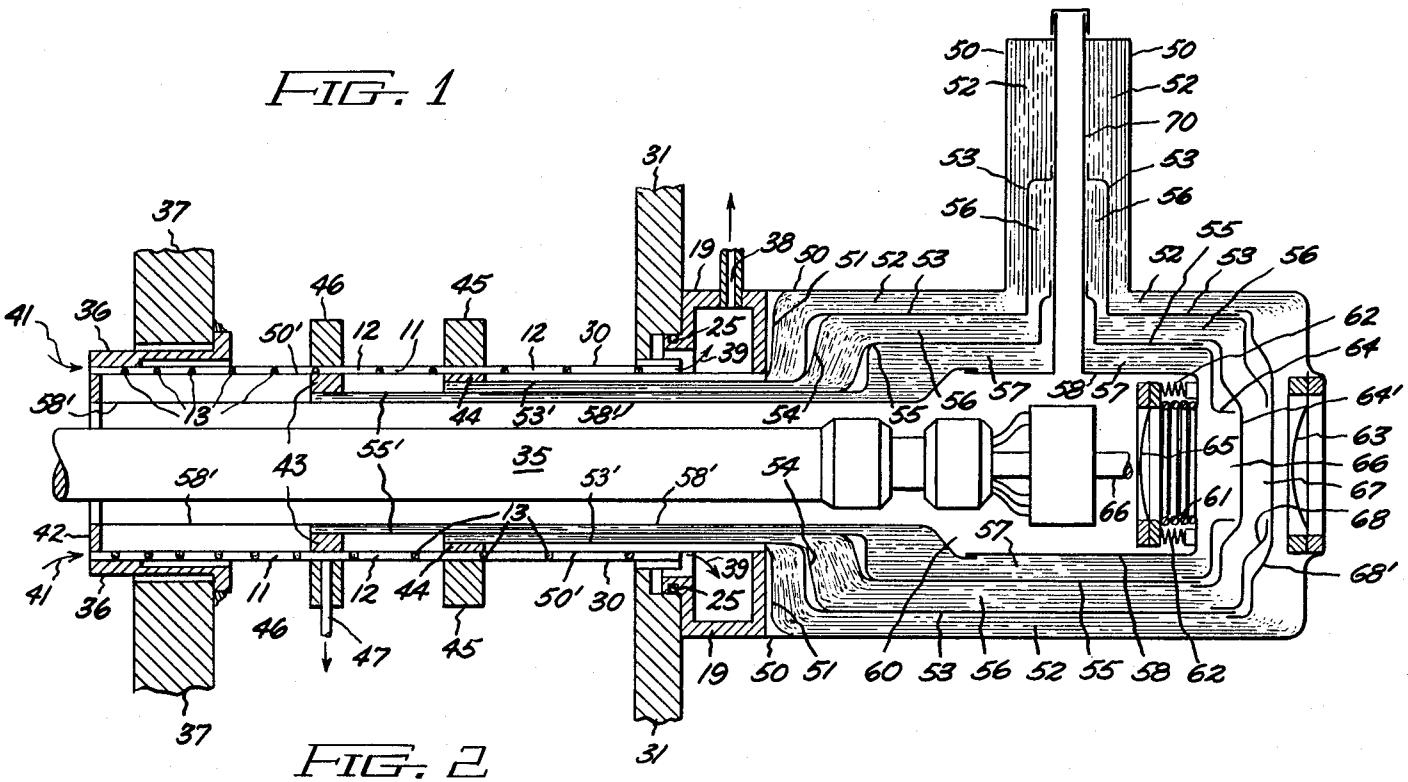
FIG. 1 is a cross-sectional side elevation view illustrating the plug and penetration assembly of the present invention.

The preferred embodiment of the present invention is illustrated in FIG. 1. In particular, FIG. 1 illustrates a horizontal cryostat penetration in which there are shown two distinct and separable assemblies. The particular elements which comprise these two assemblies are described in detail below. Suffice it to say for now that the two assemblies essentially comprise the stationary parts of the cryostat itself and the removable plug assembly in accordance with one embodiment of the present invention.

The elements comprising the stationary cryostat itself are considered first. In particular, the cryostat includes inner vessel wall 37 and outermost vessel wall 31. In operation, vacuum conditions are maintained between these walls. Additionally shown in FIG. 1 are shields 45 and 46 acting as temperature fixing stations. In particular, shield 45 is preferably nitrogen cooled so that it is maintained at a temperature of approximately 80° K. On the other hand, shield 46 is preferably cooled by helium vapor flowing through conduit 47 shown therein. Thus, shield 46 is typically maintained at a temperature of approximately 30°–50° K. It is to shields 45 and 46 to which portions of the plug of the present invention are heat stationed in operation. Walls 31 and 37 are both provided with aligned apertures for accommodation of the horizontal penetration. More particular, collar 36 is disposed in an aperture in wall 37 and is sealed to wall 37, for example, by welding. Inner vessel wall 37 and collar 36 typically comprise materials such as aluminum. Outermost vessel wall 31 typically comprises a low thermal conductivity material such as stainless steel. Shields 45 and 46 may also include interior, low emissivity coatings. It is also observed that non-retractable electrical lead 35 also forms a stationary part of the cryostat structure. Lastly, as shown in FIG. 1, the stationary cryostat structure includes tubular conduit 30 which passes at least partially through apertures in walls 37 and 31. Additionally, stationary conduit 30 is sealably joined to walls 37 and 31. In particular, in the case of wall 37, tubular conduit 30 is joined thereto by means of collar 36. Stationary tubular conduit 30 typically comprises a low thermal conductivity material such as stainless steel. Accordingly, it is seen that walls 31 and 37, collar 36, electrical lead 35 and conduit 30 comprise stationary structures with which the plug of the present invention may be employed.

The remaining structures of FIG. 1 comprise the plug or plug assembly of the present invention. In particular, the plug includes a plurality of nested housing structures 50, 53, 55 and 58. Housing 50 is the outermost housing and housing 58 is the innermost housing. Multilayer insulation 52 is disposed between outermost housing 50 and the first intermediate housing 53. Likewise, multilayer insulation 56 is disposed between first intermediate housing 53 and second intermediate housing 55. Lastly, multilayer insulation 57 is seen disposed between second intermediate housing 55 and innermost housing 58. Additionally, the multilayer insulation may also include low emissivity foil barriers 51 and 54, as shown. Each housing also includes a tubular extension, as seen in FIG. 1, disposed in operation in tubular conduit 30. Accordingly, it is seen that housing 50 includes tubular extension 50' extending into the cryostat penetration. In a like manner, first intermediate housing 53 includes tubular extension 53'; second intermediate housing 55 includes tubular extension 55'; and innermost housing 58 includes tubular extension 58'. These extensions are generally coaxial with one another. At the "cold" end of the plug (leftmost portion of FIG. 1), tubular extension 58' of the innermost housing 58 is sealably joined to the tubular extension 50' of outermost housing 50 by means of annularly shaped member 42 which preferably comprises a low thermal conductivity material. Additionally, tubular extension 55' of second intermediate housing 55 is preferably heat stationed to shield 46 by means of annularly shaped member 43. Members 55, 55' and 43 preferably comprise a high thermal conductivity material such as copper or aluminum. In a similar manner, tubular extension 53' of first intermediate housing 53 is heat stationed to shield 45 by means of annularly shaped member 44. Members 53, 53' and 44 also preferably comprise thermally conductive material such as copper or aluminum. In this way, a plurality of various temperatures may be maintained at various positions along the length of the penetration. This construction produces a penetration temperature profile which inhibits large conductive heat losses along the longitudinal axis penetration. These heat losses are further reduced by the maintenance of vacuum conditions within the plug between innermost housing 58 and outermost housing 50.

Another important feature of the present invention that is illustrated in FIG. 1, is that there is disposed about the exterior of tubular extension 50' a string-shaped length of sealing material 13 arranged in a substantially helical pattern between extension 50' and stationary tube 30. Sealing material 13 may comprise gasket material or may simply comprise a length of twine. It is additionally noted that FIG. 1 depicts sealing material as being disposed in a helical pattern which exhibits a variable pitch. In particular, sealing material 13 is disposed so that the pitch of the helical pattern increases in a direction extending from inner vessel wall 37 to outer vessel wall 31. It is also noted that, while it is possible to dispose sealing material 13 in a single helical pattern, it is also possible to employ one or more lengths of sealing material disposed in a double or triple helical pattern. In either case, it is seen that sealing material 13 provides helical flowpath 12 in gap 11 between tubes 30 and 50' for excess coolant vapor flow from the interior of the cryostat to its exterior. In particular, FIG. 1 illustrates coolant flow arrow 41 directed to the start of the helical paths which extend around and along gap 11 between extension 50' and tubular conduit 30. By providing a flowpath of this configuration, several advantages are achieved. In particular, the temperature distribution throughout any cross-section along the axial length of the penetration plug is symmetric about the center of the plug. This temperature distribution is useful in the prevention of the establishment of free convection current flowpaths for the coolant vapor in the penetration. Such free convection currents result in non-symmetric temperature distributions at any cross-section along the plug. It is further seen that the coolant vapor exits the exterior end of gap 11 and is ultimately exhausted to the exterior ambient temperature environment through channel 38, as indicated by flow arrow 39. The coolant vapor enters gap 11 at liquid helium temperature and is warmed to nearly ambient temperature when it is exhausted through channel 38. The axial temperature distribution in tubes 30 and 50' as well as the temperature of the intermediate housings 53, 55 are determined from the mass flow rate of coolant vapor through gap 11. The coolant vapor intercepts the majority of heat conducted from the warm right end of tubes 30 and 50', thus provides isolation to the inner vessel 37.

It is also noted that flow path 12 is not in fluid communication with the interior regions of the plug or the volume occupied by electrical lead 35. Accordingly, the axial and circumferential flow occurring in gap 11 is not shared by the vapor surrounding electrical lead 35. It is also seen that the entire plug assembly, including helically disposed sealing material 13 is readily removable from the cryostat penetration.

It is also seen in FIG. 1 that the plug assembly, particularly as typified by outermost housing 50 may be disposed through annular chamber 19 which preferably includes a flange and channel for O-ring gasket 25 in order to provide an airtight seal against outermost cryostat vessel wall 31. As indicated above, helium vapor from the helical path enters chamber 19 as indicated by flow arrow 39 and is then vented to the exterior through channel 38.

Another important feature of the present invention is illustrated at the right hand portion of the external portion of the plug shown in FIG. 1. In particular, outermost housing 50 includes rupture disk 63. Furthermore, innermost housing 58 also includes pressure relief means in the form of rupture disk 65. However, in general, rupture disk 65 is not installed in the same way as rupture disk 63. In particular, rupture disk 65 is affixed to a movable bellows assembly 62 and may in fact be positioned at least partially by means of spring 61. Bearing in mind that there vacuum conditions are maintained between housing 58 and housing 50, it is seen that rupture disk 65 is generally pulled to the right (toward disk 63). However, if vacuum conditions within the plug are breached, the increase in pressure, together with spring 61, acts to push rupture disk 65 against cutting stem 66 so as to cause a rupture of disk 65. This in turn leads to thermal losses resulting in expansion of gasses which ultimately leads to the rupture of disk 63. Also rupture of disk 65 is effected by expansion of gases in volume 60. Furthermore, when either disk 63 or 65 are burst, plug vacuum is lost and rupture of the other disk follows. The flow is exhausted through holes 66, 67 in shields 64 and 68. There is no multilayer insulation adjacent to these shields so that gas flow between the burst disks is not impeded. To reduce the black body radiation effects of the holes in the shield, these holes are covered with a layer of aluminum foil 61', 68' having a thickness of between about 0.25 and 0.5 mils. This foil thickness does not have sufficient strength to obstruct the flow. Burst disk 65 is also designed to rupture at a given absolute pressure of the inner cryostat vessel. In the event that the vacuum of the plug itself degrades or is completely lost, disk 65 would inadvertently burst at one atmosphere of pressure higher than desired in the plug. The use of spring and bellows mechanisms 61 and 62, respectively, prevents this. The plug assembly is also equipped with a vertical or slanted liquid helium transfer tube 70, which is heat stationed to the housings to minimize the conduction of heat into to the cold region.

Figure 2:
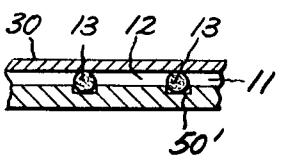
FIG. 2 is an enlarged cross-sectional side elevation view of a small portion of the penetration assembly of FIG. 1 more particularly illustrating the disposition of helically configured sealing materials.

Since several of the structures shown in FIG. 1 are in fact thin-walled structures, clarity of illustration is enhanced in FIG. 1 by the depiction of these elements as single lines. In particular, this is true of housings 50, 53, 55 and 58 and their tubular extensions 50', 53', 55' and 58'. Accordingly, FIG. 2 provides an enlarged cross-sectional view of certain of the thin-walled structures employed herein. All of the elements illustrated in FIG. 2 have been described above. However, it is of note to indicate that sealing material 13 is disposed in grooves in extension 50'. Such a construction facilitates removal of the plug. However, those skilled in the art will readily appreciate that is is also possible to provide stationary tube 30 with similar helically disposed grooves. However, such is not the preferred embodiment of the present invention.

Those skilled in the art will also appreciate that while the above description has been provided under the assumption that the penetration and plug exhibit a circular cross-section, that other cross-sections are possible. However, for ease of understanding and construction, cylindrical structures are preferred. Accordingly, as used herein and in the appended claims, the term tube or tubular is not restricted to objects exhibiting strictly circular cross-sections, but also includes cylindrical (in the general sense of the word) structures having oval, elliptical, square and similar cross-sections. Accordingly, while chamber 19 is described above as being annular, it is well understood that departure from this shape is readily provided without departing from the principles of the present invention.

It should be noted herein that while the low thermal conductivity materials for the tube and tubular conduits discussed above include such materials as stainless and glass fiber composites, it is also possible to employ such materials as titanium, nylon or plastic materials exhibiting low thermal conductivity. In particular, for the purposes of machining grooves in tubular extension 50', this extension preferably comprises glass fiber composite material. In terms of physical dimension, gap 11 between extension 50' and stationary conduit 30 is typically between about 2 mils and about 10 mils.

From the above, it may be appreciated that the penetration plug of the present invention provides a thermally efficient, horizontal cryostat penetration which is particularly useful for non-retractable electrical leads. In particular, it is seen that the present invention significantly mitigates any effects resulting from free convection secondary flows in the penetration itself. It is also seen that the present invention provides a high degree of thermal insulation in a manner which does not impede the exhaust of coolant gasses in the event of magnet quench or vacuum loss. In short, the present invention provides a thermally efficient, horizontal cryostat plug assembly that reliably relieves internal vapor pressure under appropriate circumstances.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. A plug for a horizontal penetration of a cryostat having an inner wall and an outer wall, said plug comprising:

an outermost, low thermal conductivity housing;

an inner, low thermal conductivity housing disposed within said outermost housing;

at least one intermediate high thermal conductivity housing disposed between said inner housing and said outermost housing;

thermal insulation disposed between said inner housing and said at least one intermediate housing;

thermal insulation disposed between said outermost housing and said at least one intermediate housing;

said inner housing including an inner tubular extension for insertion into said cryostat penetration, said inner extension having first heat station means for fixing the temperature of at least a portion of said inner extension;

said at least one intermediate housing including an intermediate tubular extension for insertion into said cryostat penetration, said intermediate extension having second heat station means for fixing the temperature of at least a portion of said intermediate extension;

said outermost housing including an outermost tubular extension for insertion into said cryostat penetration, said outermost extension being sealably attached to said inner tubular extension so that the volume defined by said outermost housing and said inner housing is evacuable;

said inner housing having pressure relief means disposed therein; and said outermost housing having pressure relief means disposed therein.

2. The plug of claim 1 in which said intermediate housing is heat stationed to said outermost housing extension.

3. The plug of claim 1 further including means affixed to said outermost housing to provide an airtight seal against said outermost cryostat wall.

4. The plug of claim 1 in which said pressure relief means comprise at least one rupture disk.

5. The plug of claim 1 further including at least one string-shaped length of sealing material disposed in a helical pattern on the exterior of said outermost tubular extension.

6. The plug of claim 5 in which said sealing material is disposed in grooves along the exterior of said extension.

7. The plug of claim 5 in which the pitch of said helix increases in the direction from a point on said tubular extension distal from said outermost housing toward said housing body.

8. The plug of claim 5 in which said sealing material comprises twine.

9. The penetration assembly of claim 5 in which a plurality of string-shaped lengths of sealing material are disposed in an equal plurality of helical patterns on the exterior of said outermost tubular extension.

10. The plug of claim 1 in which at least one of said housings comprises material selected from the group consisting of stainless steel, glass fiber, titanium and nylon.

11. The plug of claim 1 in which said outermost housing comprises material selected from the group consisting of stainless steel, glass fiber, titanium and nylon.

12. The plug of claim 1 in which said extensions exhibit a substantially circular cross-section.

13. The plug of claim 1 in which at least one of said pressure relief means is configured to rupture upon loss of vacuum between said inner and said outermost housings.

14. The plug of claim 1 in which said outermost housing and said inner housings are evacuable.

15. The plug of claim 1 further including a coolant transfer tube disposed through said outermost, intermediate and inner housings.

16. A plug for a horizontal penetration of a cryostat having an inner wall and an outermost wall, said plug comprising a plurality of nested housings with thermal insulation disposed therebetween, each said housing having a tubular extension which is heat stationable to a portion of said cryostat, the more inner the housing, the colder being the heat sink to which it is stationable, said inner and said outermost housings each possessing a pressure relief means disposed therein, said tubular extension of said outermost housing including at least one string-shaped length of sealing material disposed in a helical pattern on the exterior of said outermost tubular extension.

* * * * *